US009889684B2

(12) United States Patent
Masunaga

(10) Patent No.: US 9,889,684 B2
(45) Date of Patent: Feb. 13, 2018

(54) IMAGE FORMING APPARATUS

(71) Applicant: Suguru Masunaga, Kanagawa (JP)

(72) Inventor: Suguru Masunaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/351,961

(22) Filed: Nov. 15, 2016

(65) Prior Publication Data

US 2017/0151815 A1 Jun. 1, 2017

(30) Foreign Application Priority Data

Nov. 30, 2015 (JP) ..... 2015-233836

(51) Int. Cl.

| | |
|---|---|
| ***B41J 2/01*** | (2006.01) |
| ***B41J 13/00*** | (2006.01) |
| ***B41J 11/48*** | (2006.01) |
| ***B41J 13/28*** | (2006.01) |

(52) U.S. Cl.

CPC ..... *B41J 13/0009* (2013.01); *B41J 11/485* (2013.01); *B41J 13/28* (2013.01)

(58) Field of Classification Search

CPC ..... B41J 13/0009
USPC ..... 347/5, 9, 16, 104
See application file for complete search history.

(56) References Cited

U.S. PATENT DOCUMENTS 7,850,299 B2 * 12/2010 Hiroki ..... B41J 3/60 347/104
2002/0024574 A1 * 2/2002 Uchida ..... B41J 3/60 347/104
2003/0063175 A1 * 4/2003 Nishikawa ..... B41J 3/60 347/104
2008/0165242 A1 * 7/2008 Hiroki ..... B41J 13/0045 347/104
2011/0063644 A1 3/2011 Niihara et al.
2016/0121626 A1 5/2016 Masunaga et al.

FOREIGN PATENT DOCUMENTS

| | | |
|---|---|---|
| JP | 7-114235 | 5/1995 |
| JP | 2000-015883 | 1/2000 |
| JP | 2011-079298 | 4/2011 |
| JP | 2011-152789 | 8/2011 |
| JP | 2011-194680 | 10/2011 |

* cited by examiner

*Primary Examiner* — Lam Nguyen
(74) *Attorney, Agent, or Firm* — Cooper & Dunham LLP

(57) ABSTRACT

An image forming apparatus is provided including a drive source, a switching member, a drive force transmitter, a clutch, a controller, etc. The drive source drives a conveyer to rotate either normally or reversely. The switching member is swingable between an evacuation position and a striking position as a shaft rotates. The drive force transmitter transmits a drive force from the drive source to both the conveyer and the shaft. The clutch transmits the drive force to the shaft when being connected, and holds the switching member at the striking or evacuation position when being disconnected. The controller controls the drive source and the clutch such that the conveyer normally rotates to convey a manually-inserted recording medium from a manual conveyance path to an ejector and that the switching member swings from the evacuation position to the striking position, based on a signal indicating that the set position is wrong.

5 Claims, 14 Drawing Sheets

STRIKING POSITION

EVACUATION POSITION

IMAGE FORMING APPARATUS

CROSS-REFERENCE TO RELATED APPLICATIONS

This patent application is based on and claims priority pursuant to 35 U.S.C. § 119(a) to Japanese Patent Application No. 2015-233836, filed on Nov. 30, 2015 in the Japan Patent Office, the entire disclosure of which is hereby incorporated by reference herein.

BACKGROUND

Technical Field

The present disclosure relates to an image forming apparatus.

Description of the Related Art

The image forming apparatuses are known which include both a rolled sheet feeder and a manually-inserted cut sheet feeder. Such image forming apparatuses are also equipped with a conveyance path and a sheet feeding roller exclusively used for manually-inserted cut sheets.

In one example of the above-described image forming apparatuses, a cut sheet is manually inserted until the leading edge of the cut sheet strikes against a switching member held in a striking position and is automatically conveyed thereafter.

This image forming apparatus has a drawback that a time-wasting complicated operation is required to transfer the switching member to the striking position, when the sheet is set at a wrong position due to the occurrence of skew, etc., and needs to be reset at a proper position.

SUMMARY

In accordance with some embodiments of the present invention, an image forming apparatus is provided. The image forming apparatus includes a feeder, an image former, an ejector, a conveyance path, a manual feeder, a manual conveyance path, a conveyer, a drive source, a switching member, a drive force transmitter, a slip rotator, a clutch, a set position detector, and a first controller. The feeder feeds a recording medium. The image former forms an image on the recording medium. The ejector ejects the recording medium having the image thereon. The conveyance path guides the recording medium fed from the feeder to the image former. The manual feeder feeds a manually-inserted recording medium from the ejector to the manual conveyance path. The manual conveyance path guides the manually-inserted recording medium fed from the manual feeder, to the image former via a downstream side of the conveyance path in an ejection direction. The conveyer conveys the recording medium fed from the feeder to the image former via the conveyance path and conveys the manually-inserted recording medium fed from the manual feeder to the image former via the manual conveyance path. The conveyer is rotatable either normally or reversely. The drive source drives the conveyer to rotate either normally or reversely. The switching member is a claw-like member disposed on a shaft. The switching member is swingable between an evacuation position and a striking position as the shaft rotates. The switching member in the evacuation position is evacuated from the manual conveyance path to allow the manually-inserted recording medium to advance. The switching member in the striking position is entered into the manual conveyance path to allow a leading edge of the manually-inserted recording medium to strike against the switching member. The switching member is configured to switch from the striking position to the evacuation position as the conveyer reversely rotates. The drive force transmitter transmits a drive force from the drive source to both the conveyer and the shaft. The slip rotator gives a rotational load to the shaft. The clutch is coupled to the drive force transmitter. The clutch is configured to transmit the drive force to the shaft when being connected, and to hold the switching member at the striking position or the evacuation position when being disconnected owing to the rotational load from the slip rotator. The set position detector detects whether a trailing edge of the manually-inserted recording medium is positioned at a set position or not relative to the image former. The first controller controls the drive source and the clutch such that the conveyer normally rotates to convey the manually-inserted recording medium from the manual conveyance path to the ejector and that the switching member swings from the evacuation position to the striking position, based on a signal indicating that the set position is wrong, transmitted from the set position detector.

BRIEF DESCRIPTION OF THE DRAWINGS

A more complete appreciation of the disclosure and many of the attendant advantages thereof will he readily obtained as the same becomes better understood by reference to the following detailed description when considered in connection with the accompanying drawings, wherein.

Figure 1:
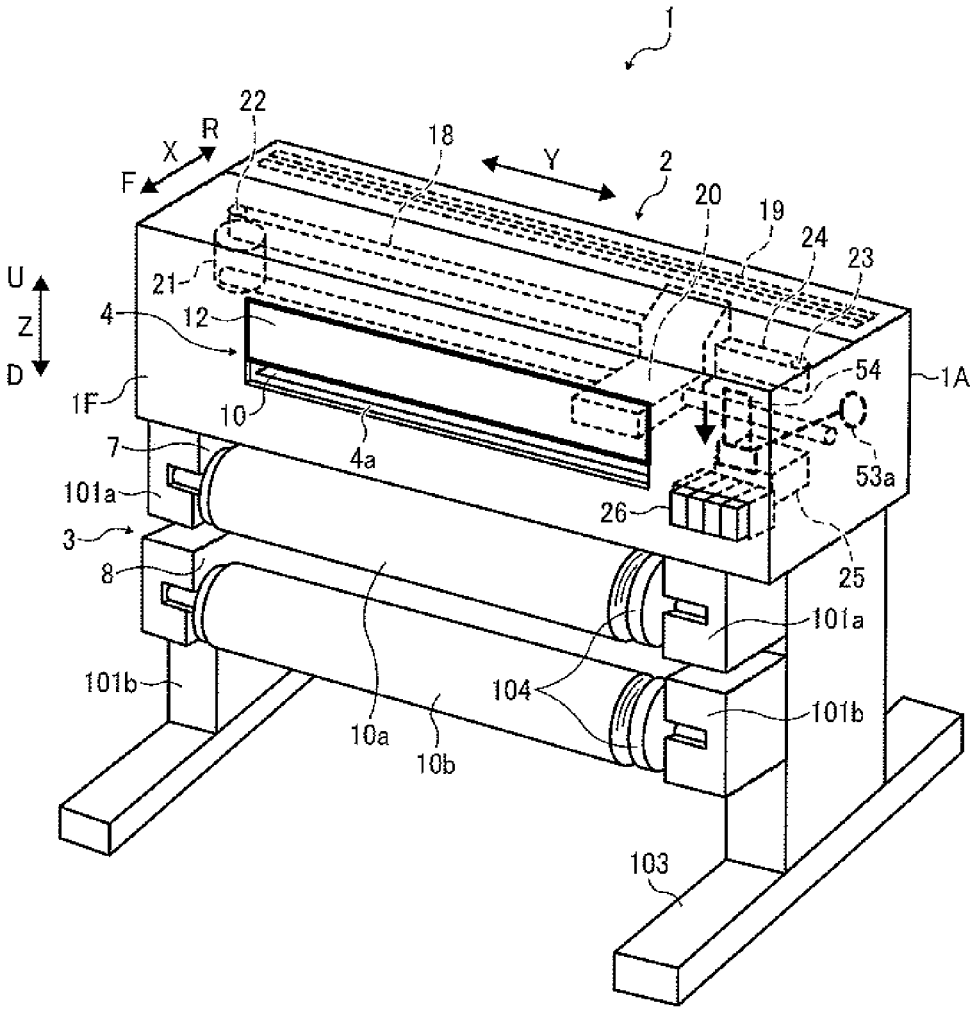
FIG. 1 is a perspective view of an image forming apparatus according to a first embodiment of the present invention in which a pressure releasing lever is in a pressurizing state.

The accompanying drawings are intended to depict example embodiments of the present invention and should not be interpreted to limit the scope thereof The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will he given to identical constituent elements such as parts and materials having the same functions and redundant descriptions thereof omitted unless otherwise stated.

In accordance with some embodiments of the present invention, an image forming apparatus is provided which is easy to reset the position of a manually-inserted recording medium.

Embodiment 1

Figure 2:
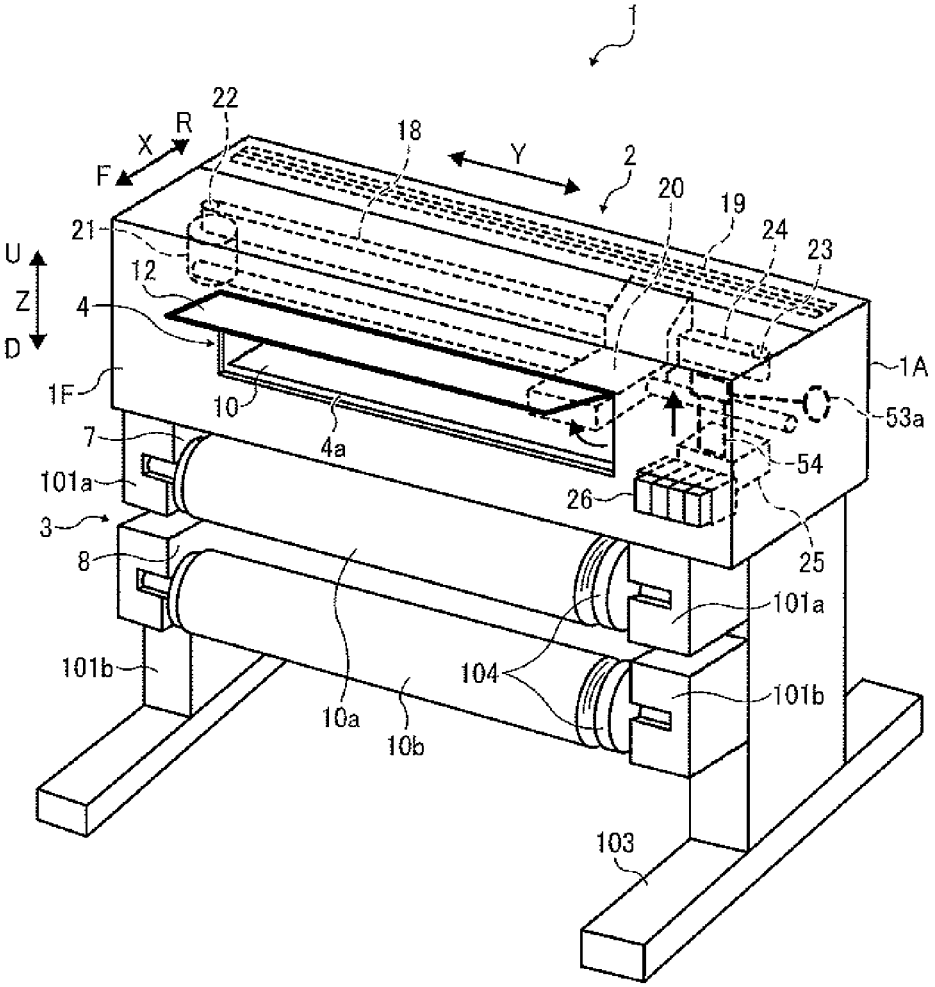
FIG. 2 is a perspective view of the image forming apparatus according to the first embodiment of the present invention in which the pressure releasing lever is in a depressurizing state.
Figure 3:
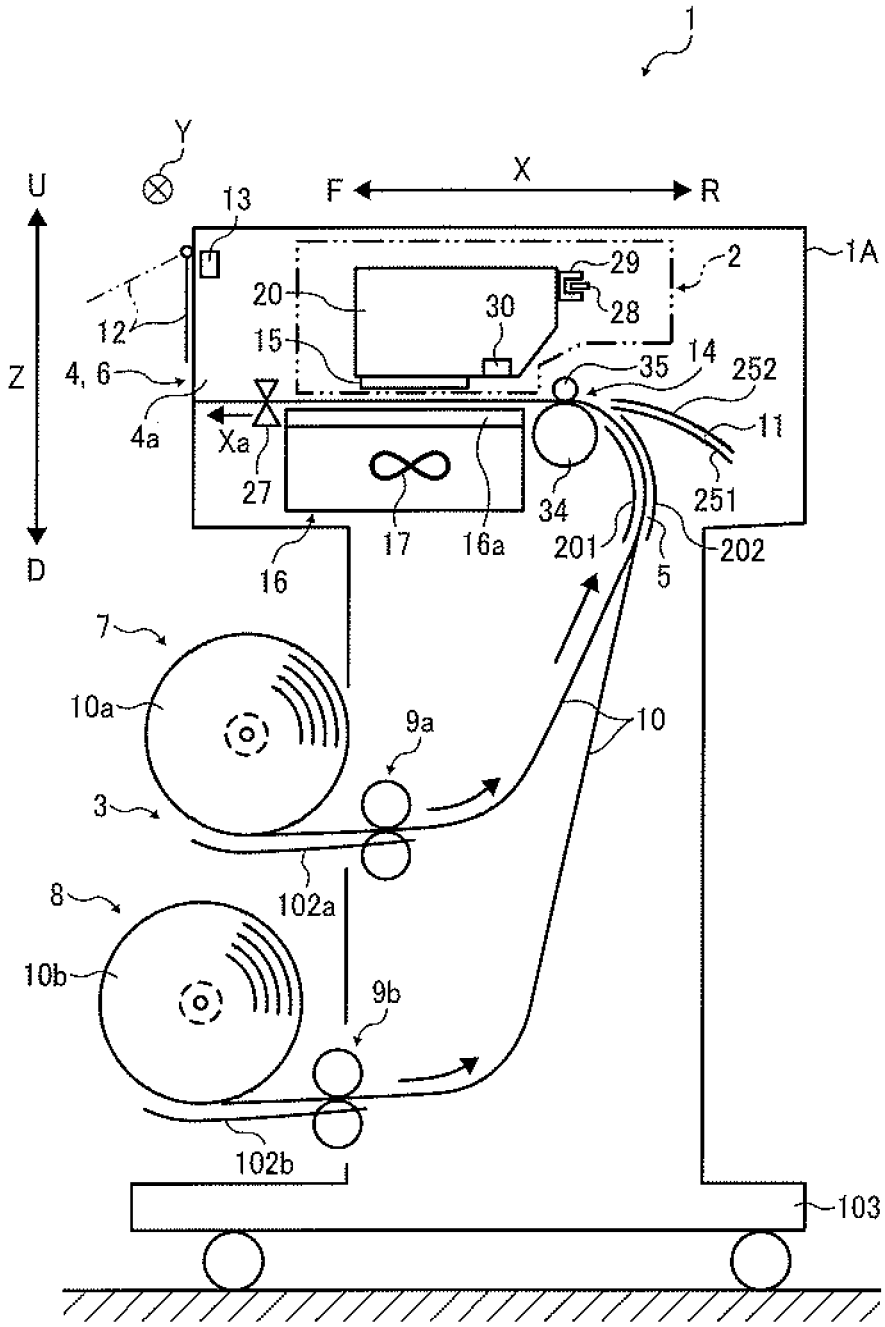
FIG. 3 is a side of the image forming apparatus illustrated in FIG. 1.

A first embodiment of the present invention is described below with reference to FIGS. 1 to 3. FIG. 1 is a perspective view of an image forming apparatus according to a first embodiment of the present invention in which a pressure releasing lever is in a pressurizing state. FIG. 2 is a perspective view of the image forming apparatus according to the first embodiment of the present invention in which the pressure releasing lever is in a depressurizing state. FIG. 3 is a cross-sectional side view of the image forming apparatus illustrated in FIG. 1.

An image forming apparatus 1 illustrated in FIGS. 1 to 3 is an inkjet recording apparatus, more specifically, an inkjet printer capable of discharging ink droplets onto a recording medium to print an image on the recording medium according to image data.

Referring to FIGS. 1 to 3, the image forming apparatus 1 includes an apparatus body 1A. Directions X and Y represent a front-back direction (sub-scanning direction) and a width direction (main scanning direction), respectively, of the apparatus body 1A. The directions X and Y are perpendicular to each other. A direction Z represents an upside-downside direction (height/vertical direction) of the apparatus body 1A. The direction Z is perpendicular to both the directions X and Y. With respect to the front-back direction X, F and R respectively indicate front and rear sides of the apparatus body 1A. With respect to the upside-downside direction Z, U and D respectively indicate upside and downside of the apparatus body 1A.

The image forming apparatus 1 is a compact apparatus which requires no large installation space. The image forming apparatus 1 is capable of feeding manually-inserted cut sheets or long sheets (a long sheet refers to a part of a rolled sheet) without causing skew or paper jam. The image forming apparatus 1 is configured such that long sheets easily insertable. Moreover, the image forming apparatus 1 is configured such that a registration roller and a pressure roller are contactable with and separable from each other by a manual operation. Compared to high-end image forming apparatuses in which the registration roller and the pressure roller are automatically contactable with and separable from each other, or in which the pressing force is variable in accordance with the sheet size, the image forming apparatus 1 includes a lesser number of components with a lower cost.

Referring to FIGS. 1 to 3, the image forming apparatus 1 includes an image former 2 on an upper part and a feeder 3 on a lower part. The feeder 3 includes spool bearing stands 101*a* and 101*b*.

The image former 2 forms an image on a recording medium by means of inkjet recording. The recording medium may be either a long sheet 10 or a cut sheet. The image forming apparatus 1 is a serial type inkjet recording apparatus.

Referring to FIGS. 1 to 3, the image forming apparatus 1 includes an ejector 4 to eject the recording medium after the image former 2 has formed an image thereon. The ejector 4 is disposed on the front side F of the apparatus body 1A. The ejector 4 includes a platen guide plate 16*a* and an ejection port 4*a* disposed above the platen guide plate 16*a*. The platen guide plate 16*a* receives and guides the recording medium to be ejected to the ejection port 4*a*. The ejection port 4*a* ejects the recording medium.

The ejector 4 further includes a front cover 12 that is openable and closable, to allow a user to manually insert a recording medium or to remove paper jam. The front cover 12 is swingable about a hinge disposed on an upper part of the front side F of the apparatus body 1A, so that the lower part of the front cover 12 is openable and closable. A front cover open sensor 13 is disposed on the apparatus body 1A in proximity to the hinge of the front cover 12. The front cover open sensor 13 detects whether the front cover 12 is in an open state or a closed state. The front cover open sensor 13 is turned on when the front cover 12 is opened by a user.

The feeder 3 is capable of feeding the sheet 10, in the form of a long sheet, drawn from a sheet roll 10*a* or 10*b* stored in the spool bearing stand 101*a* or 101*b*, respectively. The spool bearing stands 101*a* and 101*b* are aligned in the upside-downside (vertical) direction Z of the apparatus body 1A. The spool beating stands 101*a* and 101*b* store the sheet rolls 10*a* and 10*b*, respectively, so that the sheet 10 is drawable from the sheet roll 10*a* or 10*b*.

The sheet roll 10*a* on the upper side (hereinafter "upper sheet roll 10*a*") and the sheet roll 10*b* on the lower side (hereinafter "lower sheet roll 10*b*") are rotatabiy supported by the spool bearing stands 101*a* and 101*b*, respectively. The sheet 10 is selectively drawable from the upper sheet roll 10*a* or the lower sheet roll 101*b*. Referring to FIGS. 1 and 3, the image forming apparatus 1 further includes sheet roll guides 102*a* and 102*b*, a stand 103 disposed on a lower part of the apparatus body 1A, and spool flanges 104.

The upper sheet roll 10*a* and the lower sheet roll 10*b* are stored at a lower end part and a front surface side of the apparatus body 1A. A front surface 1F of the apparatus body 1A has openings 7 and 8 through which the upper sheet roll 10*a* and the lower sheet roll 10*b*, respectively, are replaceable.

At the periphery of the spool bearing stands 101*a* and 101*b*, a drive motor and a drive force transmitter are provided, capable of drawing out the sheet 10 from the upper sheet roll 10*a* or the lower sheet roll 10*b*, conveying the sheet 10, and rewinding the conveyed sheet 10.

In place of the above-described spool bearing stands 101*a* and 101*b*, flange hearing stands may support the sheet rolls 10*a* and 10*b* so that the sheet 10, in the form of a long sheet, is drawable therefrom.

The image former 2 includes a guide rod 18 and a guide rail 19 each supported by side plates disposed on the left and right sides of the apparatus body 1A in the width direction Y. The guide rod 18 and the guide rail 19 moveably hold a carriage 20 in the main scanning direction Y.

The carriage 20 includes liquid recording heads 15 for discharging black, yellow, magenta, and cyan ink droplets, respectively. Each liquid recording head 15 integrally includes a sub tank for retaining an ink to be supplied thereto.

A main scanning mechanism that moves the carriage 20 in the main scanning direction Y includes a drive motor 21, a drive pulley 22, a driven pulley 23, and a belt 24. The drive motor 21 is disposed on one side (left side in FIG. 1) in the main scanning direction Y. The drive pulley 22 is coupled to the output shaft of the drive motor 21 to be rotary-driven thereby. The driven pulley 23 is disposed on the other side (right side in FIG. 1) in the main scanning direction Y. The belt 24 is stretched between the drive pulley 22 and the driven pulley 23.

The driven pulley 23 is pulled by a tension spring in a direction away from the drive pulley 22.

As illustrated in FIG. 3, a platen 16 is disposed below the liquid recording heads 15 of the carriage 20, covering over a recording area extending in the main scanning direction Y of the carriage 20. The platen 16 serves as a recording medium guide for guiding a rolled sheet or a manually-inserted sheet. The platen 16 has a large number of pores for sucking air. The platen 16 includes the platen guide plate 16*a* and a suction fan 17 disposed below the platen guide plate 16*a*.

As illustrated in FIG. 3, an encoder sheet 28 is disposed between the side plates along the main scanning direction Y of the carriage 20, for detecting the position of the carriage 20 in the main scanning direction Y. An encoder sensor 29 for reading the encoder sheet 28 is mounted on the carriage 20. As the encoder sensor 29 reads the encoder sheet 28, the position of the carriage 20 in the main scanning direction Y is detected.

As illustrated in FIG. 3, the carriage 20 includes a sheet end detection sensor 30 for detecting an end of the recording medium. The sheet end detection sensor 30 includes a reflective photosensor. As the carriage 20 moves to a position corresponding to the right end of the sheet 10 in the main scanning direction Y, the sheet end detection sensor 30 detects the right end of the sheet 10 drawn from the sheet roll 10*a* or the sheet roll 10*b*. The carriage 20 then moves to a position corresponding to the left end of the sheet 10 in the main scanning direction Y, and the sheet end detection sensor 30 detects the left end of the sheet 10. The size of the sheet 10 is determined from the difference between the values detected by the sheet end detection sensor 30 at the right and left ends of the sheet 10, corresponding to the positions of the right and left ends of the sheet 10 in the main scanning direction Y read by the encoder sensor 29.

Figure 4:
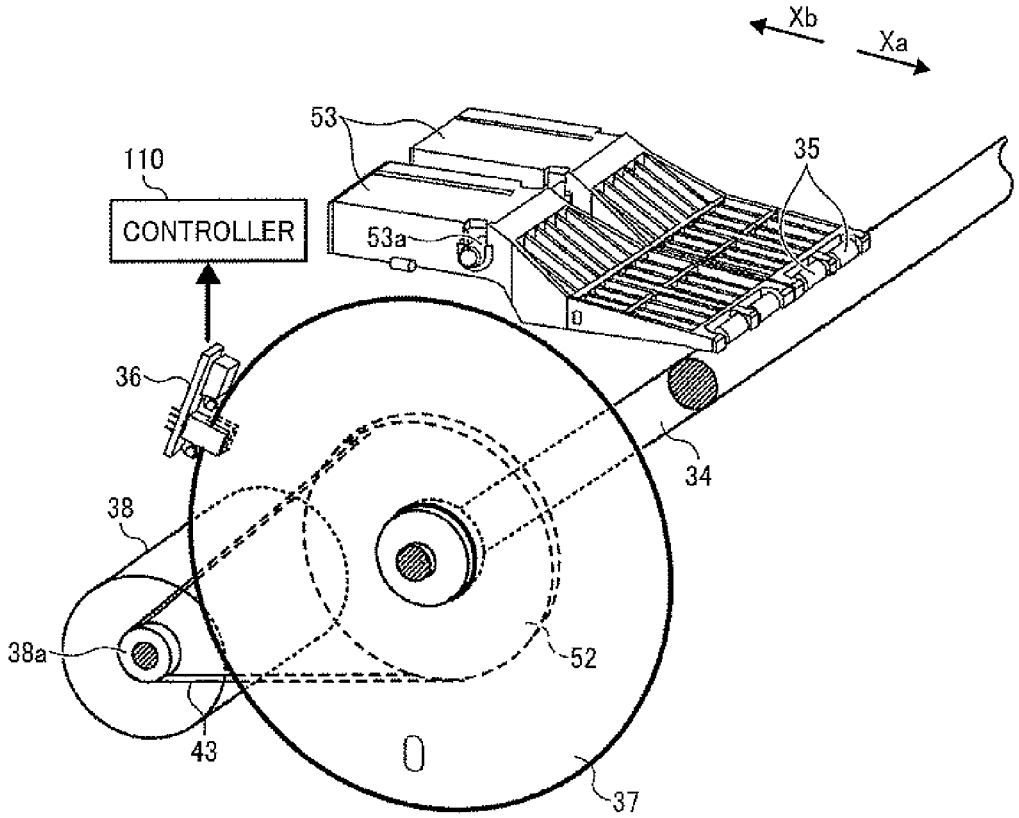
FIG. 4 is a perspective view of a registration roller and periphery thereof included in the image forming apparatus illustrated in FIGS. 1 to 3.

A sheet conveying device is described below with reference to FIGS. 3 and 4. FIG. 4 is a perspective view of a registration roller and periphery thereof, composing a sheet conveying device, included in the image forming apparatus 1 illustrated in FIGS. 1 to 3. The sheet 10 drawn from the sheet roll 10*a* or the sheet roll 10*b* is conveyed by the sheet conveying device illustrated in FIG. 4 within the recording area in the main scanning region of the carriage 20.

Referring to FIG. 4, the sheet conveying device includes a registration roller 34, multiple pressure rollers 35, a drive motor 38, an encoder sheet 37, and an encoder sensor 36.

The registration roller 34 and each of the pressure rollers 35 form a pair of holding-conveying members contactable with and separable from each other, serving as a conveyer. The registration roller 34 is a drive roller rotary-driven by the drive motor 38. The pressure rollers 35 are driven rollers driven by the registration roller 34. The registration roller 34 and the pressure rollers 35 are supported by inner side plates so as to be rotatable either normally or reversely.

A motor pulley 38*a* is disposed on the output shaft of the drive motor 38. A registration large-diameter pulley 52 is secured to one end of the registration roller 34. A timing belt 43 is wound around the motor pulley 38*a* and the registration large-diameter pulley 52. A rotation or drive force of the drive motor 38 is transmitted to the registration roller 34 via the timing belt 43. Each of the motor pulley 38*a* and the registration large-diameter pulley 52, as well as the later-described other pulleys wound around another timing belt, is a toothed pulley (timing pulley).

The drive motor 38 may include a DC motor. The drive motor 38 serves as a single drive source for driving the conveyer to rotate either normally or reversely. The drive motor 38 is secured to an inner side plate fixed to the apparatus body 1A.

The pressure rollers 35 are rotatably supported by a common shaft disposed at an end of at arm-like pressure roller bracket 53. The pressure rollers 35 are divided and skewered rollers. Each pressure roller bracket 53 supports two pressure rollers 35. The pressure roller bracket 53 includes a wire spring for applying a pressing force (biasing force) in a direction in which the pressure rollers 35 is pressed against the registration roller 34.

As illustrated in FIG. 4, the pressure roller bracket 53 is swingably mounted on a shaft 53*a* supported by the apparatus body 1A, at the opposite end from the end supporting the pressure rollers 35. The pressure rollers 35 are swingable about the shaft 53*a* via the pressure roller bracket 53 between a pressurizing position and a depressurizing position. At the pressurizing position, the pressure rollers 35 are pressed against the registration roller 34. The depressurizing position is a position separated away from the pressurizing position.

As illustrated in FIGS. 1 and 2, a pressure releasing lever 54 is mounted on the shaft 53*a* of the pressure roller bracket 53. The pressure rollers 35 are switchable between the pressurizing position and the depressurizing position by manually operating the pressure releasing lever 54. The pressure releasing lever 54 is disposed inside the apparatus body 1A, and therefore operable when the front cover 12 is opened. When the pressure releasing lever 54 is pushed down, as illustrated in FIG. 1, the pressure rollers 35 occupy the pressurizing position. When the pressure releasing lever 54 is lifted up, as illustrated in FIG. 2, the pressure rollers 35 occupy the depressurizing position.

The pressure releasing lever 54 may be replaced with another pressure releaser, such as a pressure releasing mechanism and a link mechanism having an operation lever.

The encoder sheet 37 is a disk-like member disposed coaxially with the registration roller 34. The encoder sensor 36 includes a transmissive photosensor having a light emitting part and a light receiving part. The encoder sensor 36 is secured to an inner side plate so as to grip the outer peripheral edge of the encoder sheet 37.

On one end side (right side in FIG. 1) of the main scanning region of the carriage 20, a maintenance unit 25 is disposed for maintaining the liquid recording heads 15 of the carriage 20. In addition, a main cartridge 26 is detachably mounted on the apparatus body 1A. The main cartridge 26 stores inks to be supplied to the sub tanks of the liquid recording heads 15.

A cutter 27 is disposed in the vicinity of the ejection port 4*a* of the ejector 4 in the image former 2. The cutter 27 cuts the sheet 10 into a piece having a predetermined length. The cutter 27 is secured to a wire or timing belt wound around multiple pulleys, one of which being coupled to a cutter drive motor. As the cutter drive motor moves in the main scanning direction Y, the cutter 27 cuts the sheet 10 into a piece having a predetermined length.

A sheet feeding and conveying operations and an image forming operation when the feeder 3 feeds the sheet 10 are described below with reference to FIGS. 1 to 4. As illustrated in FIG. 3, in the feeder 3, the sheet 10 drawn from the sheet roll 10*a* or the sheet roll 10*b* is held and conveyed by a conveyance roller pair 9*a* or 9*b*, the registration roller 34, and the pressure rollers 35. The conveyance roller pairs 9*a* and 9*b* are disposed upstream from a conveyance path 5. The sheet 10 is smoothly conveyed through the conveyance path 5 while being guided by a driven guide roller 48 disposed at a curved portion of the conveyance path 5, to be described in detail later with reference to FIG. 5, etc.

The conveyance path 5 is formed of sheet conveyance guide members 201 and 202. The sheet 10 passes through the conveyance path 5 to reach the image former 2. In the image former 2, the liquid recording heads 15 discharge colored liquid droplets onto the sheet 10 to form an image on the sheet 10 in accordance with image data. A pre-registration sensor 49 is disposed in the vicinity of the conveyance path 5, to be described in detail later with reference to FIG. 5, etc. The pre-registration sensor 49 includes a reflective photosensor. The pre-registration sensor 49 detects a leading or trailing edge of the sheet 10 pass through the conveyance path 5, in other words, detects the presence of the sheet 10 within the conveyance path 5. After an image has been formed on the sheet 10, the cutter 27 moves in the main scanning direction Y and cuts the sheet 10 into a piece having a predetermined length. The cut piece of the sheet 10 is ejected onto an ejection tray.

While the image former 2 is performing an image forming operation, the sheet 10 is intermittently conveyed in a direction indicated by arrow Xa (hereinafter "ejection direction Xa") along the sub-scanning direction (i.e., the front-back direction X). The sub-scanning direction X is perpendicular to the main scanning direction Y along which the carriage 20 moves. The amount of conveyance is controlled by a controller 110 based on information obtained by the encoder sensor 36 by reading the encoder sheet 37 coaxially disposed with the registration roller 34.

Figure 5:
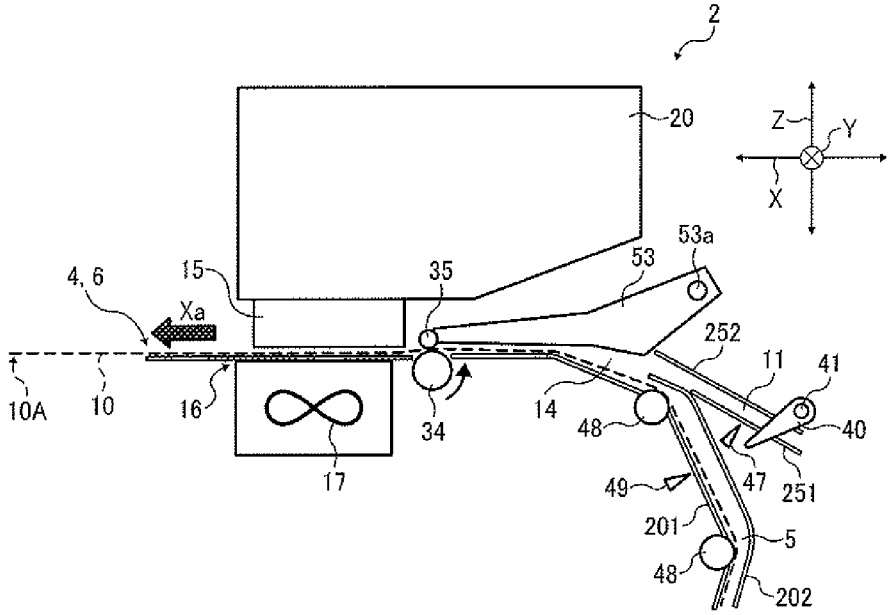
FIG. 5 is a partial side view of the image forming apparatus illustrated in FIGS. 1 to 3 in which a rolled sheet is conveyed.
Figure 6:
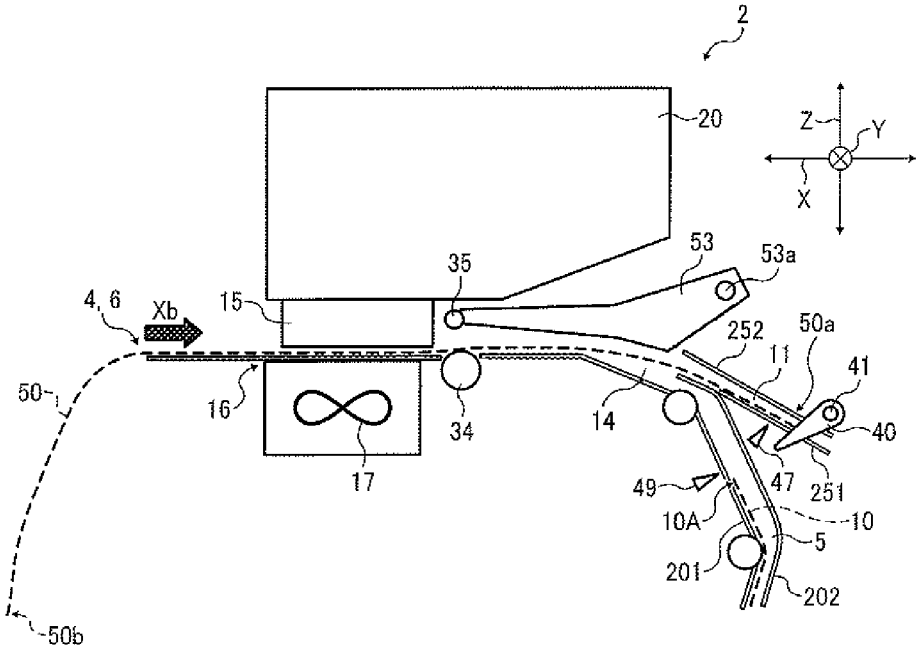
FIG. 6 is a partial side view of the image forming apparatus illustrated in FIGS. 1 to 3 in which a cut sheet is manually inserted.

A manual feeder and a manual conveyance path are described below with reference to FIGS. 1 to 3, 5, and 6. FIG. 5 is a partial side view of the image forming apparatus 1 in which a rolled sheet is conveyed. FIG. 6 is a partial side view of the image forming apparatus 1 in which a cut sheet is manually inserted.

As illustrated in FIGS. 3 and 6, the image forming apparatus 1 includes a manual feeder 6. The manual feeder 6 allows a recording medium, such as a cut sheet 50 indicated by a broken line in FIG. 6, to be inserted through the ejector 4 toward the image former 2. The manual feeder 6 partially combines the function of the ejector 4.

As illustrated in FIGS. 3, 5, and 6, the image forming apparatus 1 includes a manual conveyance path 11 to guide the cut sheet 50 manually inserted from the manual feeder 6 to the image former 2 via a downstream side of the conveyance path 5 in the ejection direction Xa. The manual conveyance path 11 is formed of manual sheet conveyance guide plates 251 and 252.

The conveyance path 5 and the manual conveyance path 11 join together on a downstream side of the conveyance path 5, thereby forming a joined conveyance path 14. The joined conveyance pad 14 extends from the joined position of the conveyance path 5 with the manual conveyance path 11 to the ejection port 4*a* of the ejector 4.

As described above, the conveyer, including the registration roller 34 and the pressure rollers 35, has a function of conveying the sheet 10 fed from the feeder 3 to the image former 2 via the conveyance path 5. At the same time, the conveyer has another function of conveying the cut sheet 50 manually inserted from the manual feeder 6 to the image former 2 via the manual conveyance path 11, while being rotatable either normally or reversely.

Figure 7:
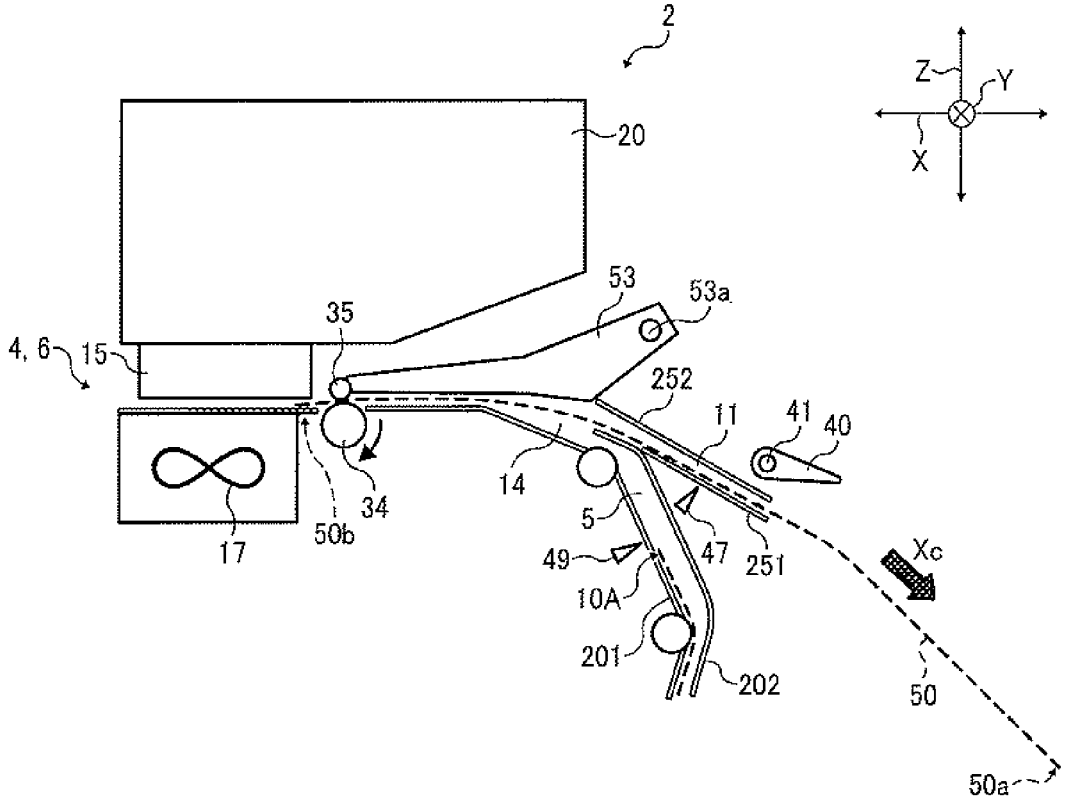
FIG. 7 is a side view of the image forming apparatus illustrated in FIGS. 1 to 3 in which a manually-inserted cut sheet is being fed to a set position.

As illustrated in FIGS. 5 and 6, a switching member 40 is disposed on a downstream side of the manual conveyance path 11 relative to an insertion direction Xb of the cut sheet 50. The switching member 40 is a claw-like member disposed on the shaft 41. The switching member 40 is swingable as the shaft 41 rotates. The switching member 40 is swingable between an evacuation position and a striking position. When in the evacuation position, as illustrated in FIG. 7, the switching member 40 is evacuated from the manual conveyance path 11 to allow the manually-inserted cut sheet 50 to advance. When in the striking position, as illustrated in FIG. 6, the switching member 40 is entered into the manual conveyance path 11 to allow a leading edge 50*a* of the cut sheet 50 to strike against the switching member 40.

In particular, multiple switching members 40 are disposed on the shaft 41 in a longitudinal direction in a cyclic manner within a region where the cut sheet 50 passes within the manual conveyance path 11. When the switching member 40 is in the striking position, as illustrated in FIG. 6, the cut sheet 50 is properly set without causing bending on the leading edge 50*a*. The manual sheet conveyance guide plates 251 and 252 have multiple cutouts so that the multiple switching members 40 disposed on the shaft 41 in the longitudinal direction become movable and swingable within the manual conveyance path 11.

A manual sensor 47 is disposed downstream from the switching member 40 on the manual conveyance path 11 relative to the ejection direction Xa. The manual sensor 47 detects presence of the manually-inserted cut sheet 50. The manual sensor 47 includes a reflective photosensor.

Figure 8:
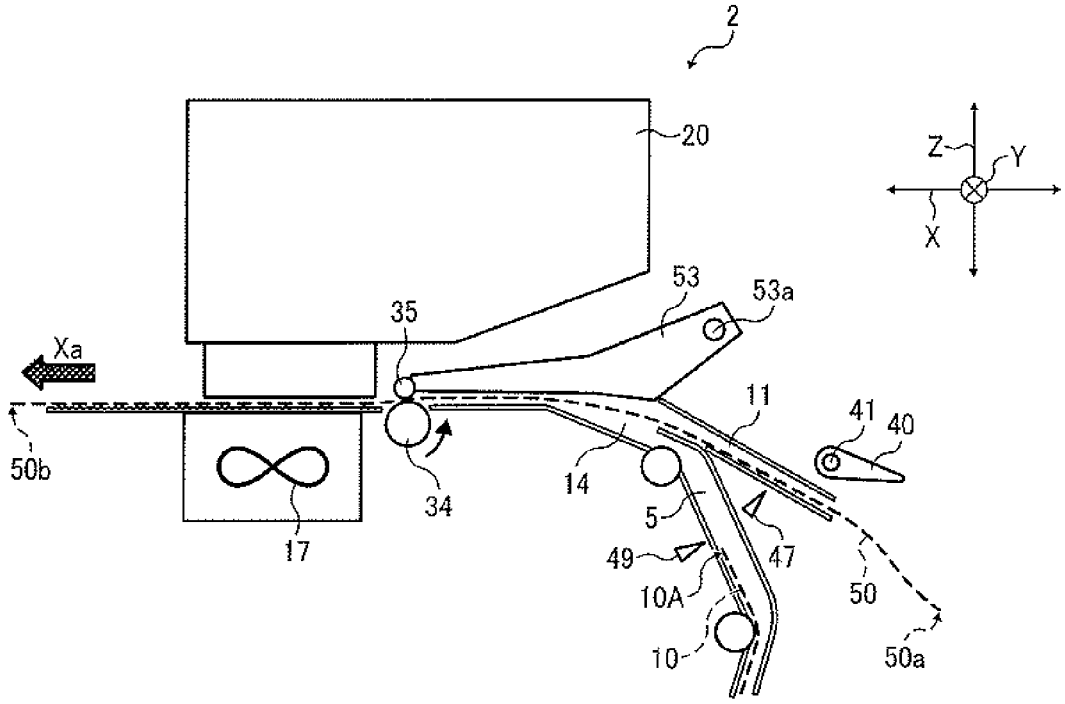
FIG. 8 is a side view of the image forming apparatus illustrated in FIGS. 1 to 3 in which an image is being printed on a manually-inserted cut sheet.

A conveyance operation is described below with reference to FIGS. 5 to 8. FIG. 7 is a side view of the image forming apparatus 1 in which a manually-inserted cut sheet is being fed to a set position (i.e., a print start position, to be described in detail later). FIG. 8 is a side view of the image forming apparatus 1 in which an image is being printed on the manually-inserted cut sheet.

First, a conveyance operation for conveying the sheet 10 drawn from the sheet roll 10*a* or 10*b* (hereinafter simply "the sheet roll") is described with reference to FIG. 5. The sheet 10 drawn from the sheet roll, indicated by a broken line, is held and conveyed by the registration roller 34 and the pressure rollers 35 in the ejection direction Xa, while the registration roller 34 is normally rotating in the direction indicated by arrow in FIG. 5. The liquid recording heads 15 of the carriage 20 print an image on the sheet 10 being conveyed. At this time, the switching member 40 is in the striking position to block the manual conveyance path 11, without exerting influence on conveyance of the sheet 10 within the conveyance path 5.

A manual insertion-feeding operation for cut sheets is described with reference to FIG. 6.

During the manual insertion-feeding operation, the sheet 10 drawn from the sheet roll should be temporarily evacuated from the joined position of the conveyance path 5 with the manual conveyance path 11 to an upstream side thereof. Thus, the registration roller 34 is reversely rotated and the sheet roll is wound back, to evacuate a leading edge 10A of the sheet 10 to a position near the pre-registration sensor 49.

Next, the front cover 12 is opened, as illustrated in FIG. 2, and the pressure releasing lever 54 is operated in the direction indicated by arrow in in FIG. 2, so that the pressure rollers 35 are separated upward from the registration roller 34 to he held in the depressurizing position. The cut sheet 50, indicated by a broken line in FIG. 6, is then inserted from the ejection port 4*a* (illustrated in FIG. 2) until the leading edge 50*a* of the cut sheet 50 strikes against the switching member 40 held in the striking position. At this time, the switching member 40 held in the striking position properly sets the cut sheet 50 without bending it.

Whether or not the leading edge 50*a* of the cut sheet 50 has struck against the switching member 40 is detected by the manual sensor 47. It is preferable that the inserted cut sheet 50 is prevented from shifting until the pressure rollers 35 are switched to the pressurizing state, as illustrated in FIG. 1, by operating the pressure releasing lever 54. Specifically, it is preferable that the suction fan 17 of the platen 16 is put into operation so that the cut sheet 50 is sucked by the suction fan 17 and held on the platen 16. It is preferable that the manual conveyance path 11 (i.e., the gap between the manual sheet conveyance guide plates 251 and 252) is made narrower toward the switching member 40 so that the leading edge 50*a* of each cut sheet 50 is aligned.

Figure 9A:
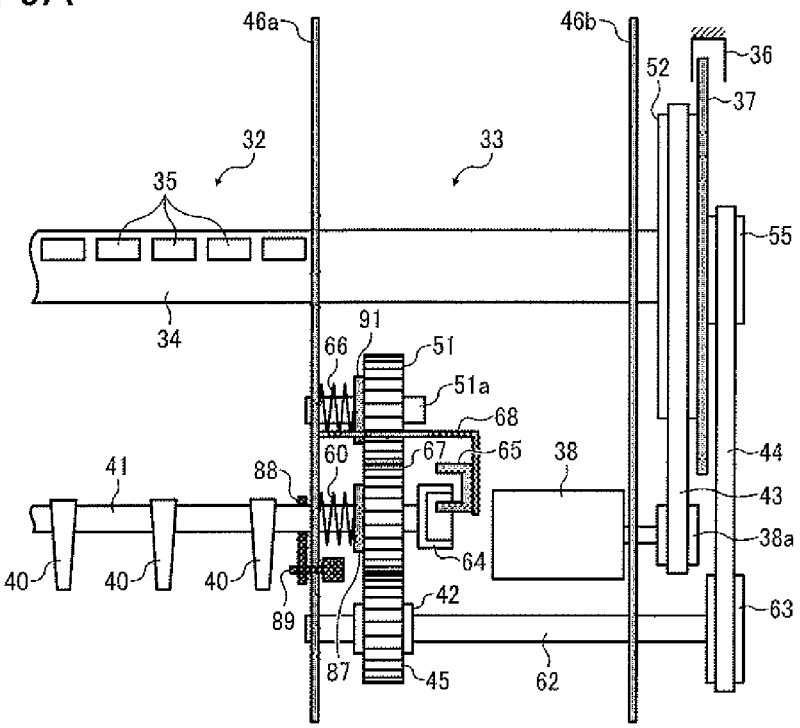
FIG. 9A is a plan view of a major part of a driver included in the image forming apparatus illustrated in FIGS. 1 to 3.

Next, after the pressure releasing lever 54 is operated such that the pressure rollers 35 are pressed against the registration roller 34, the registration roller 34 is reversely rotated in a direction indicated by arrow in FIG. 7. Thus, a trailing edge 50*b* of the cut sheet 50 is automatically conveyed to the print start position. (The trailing edge 50*b* switches to a leading edge when an image is being printed on the cut sheet 50.) At this time, the set position of the cut sheet 50 is checked. As the registration roller 34 is reversely rotated while an electromagnetic clutch, to be described later referring to FIG. 9A, is connected, the cut sheet 50 having struck against the switching member 40 is conveyed in a conveyance direction Xc. At the same time, the switching member 40 starts swinging and shifts to the evacuation position.

When the gear ratio is set such that the rotation speed of the switching member 40 is slower than the sheet conveyance speed, the cut sheet 50 will be pressed against the switching member 40 and damaged or bent thereby. To prevent this phenomenon, the gear ratio is set such that the circumferential speed of the switching member 40 at the position where the leading edge 50*a* of the cut sheet 50 strikes thereon is faster than the sheet conveyance speed of the registration roller 34. In this case, the switching member 40 can be moved to the evacuation position without the cut sheet 50 being pressed against the switching member 40, and the cut sheet 50 can be normally conveyed.

As illustrated in FIG. 8, the switching member 40 is held at the evacuation position when an image is being printed on the manually-inserted cut sheet 50. The switching member 40 exerts no influence on the printing operation. As illustrated in FIG. 8, while the cut sheet 50 is being conveyed within the manual conveyance path 11 in the ejection direction Xa by the registration roller 34 normally rotating and the pressure rollers 35, the liquid recording head 15 print an image on the cut sheet 50.

Figure 9B:
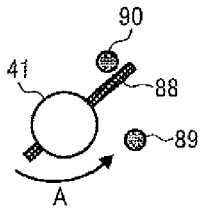
FIG. 9B is an illustration of a striking position of a switching member included in the image forming apparatus illustrated in FIGS. 1 to 3.
Figure 9C:
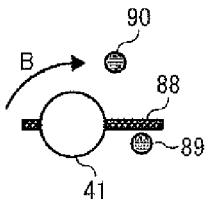
FIG. 9C is an illustration of an evacuation position of the switching member.
Figure 10:
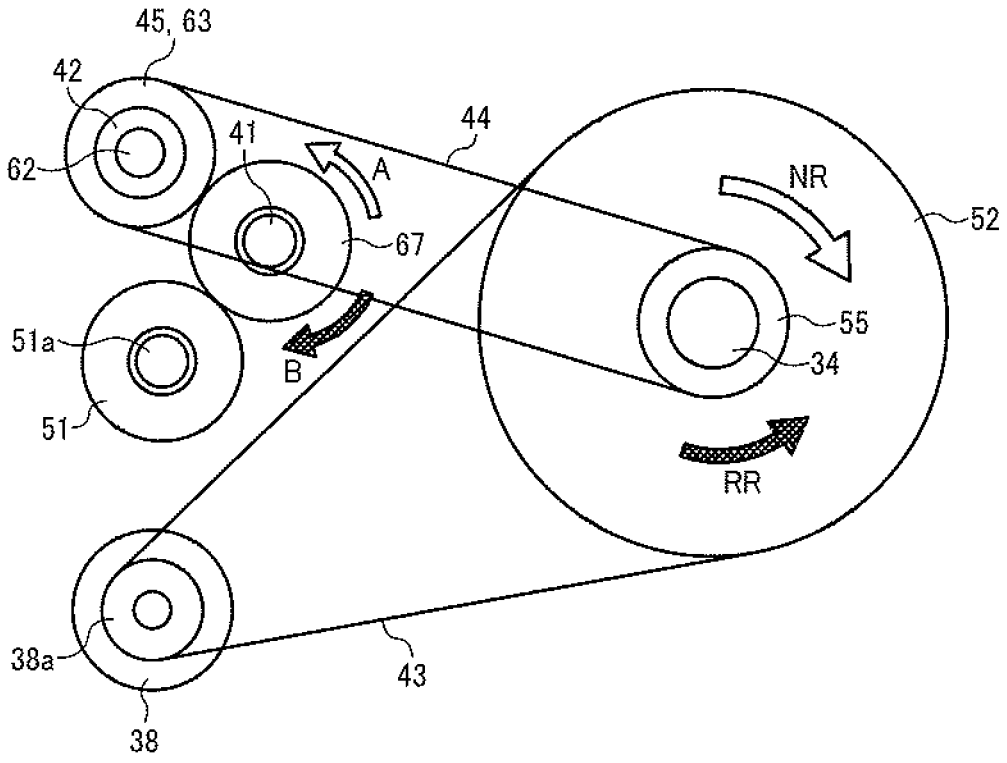
FIG. 10 is a right side view of the driver illustrated in FIG. 9A.

A driver for driving the conveyer is described below with reference to FIGS. 9A to 9C and 10. FIG. 9A is a plan view of a major part of a driver. FIG. 9B is an illustration of the striking position of the switching member 40. FIG. 9C is an illustration of the evacuation position of the switching member 40. FIG. 10 is a right side view of the driver illustrated in FIG. 9A.

Referring to FIG. 9A, numerals 32 and 33 respectively denote the conveyer and the driver. The driver 33 includes the sheet conveying device illustrated in FIG. 4, the drive motor 38, the encoder sensor 36, the encoder sheet 37, the timing belt 43, another timing belt 44, an electromagnetic clutch 42, a clutch gear 45, a gear 51, a registration small-diameter pulley 55, a transmission shaft 62, a transmission shaft pulley 63, a gear 67, springs 60 and 66, disc members 87 and 91, a filler 64, a position detection sensor 65, a spring pin 88, and a screw pin 89.

A drive force transmitter, for transmitting a drive force of the drive motor 38 to the conveyer (i.e., the registration roller 34 and the pressure rollers 35) and to the shaft 41 of the switching member 40, is described below with reference to FIGS. 9A to 9C and 10. The drive force transmitter includes: the motor pulley 38*a*, the timing belt 43, and the registration large-diameter pulley 52 that are included in the sheet conveying device illustrated in FIG. 4; the registration small-diameter pulley 55; the timing belt 44; the transmission shaft 62; the transmission shaft pulley 63; and the clutch gear 45, the gear 51, and the gear 67 that are forming a gear array.

On one end of the registration large-diameter pulley 52 of the registration roller 34, the registration small-diameter pulley 55 is coaxially disposed. The transmission shaft 62 is rotatably supported by inner side plates 46*a* and 46*b*. The transmission shaft pulley 63 is secured to one end of the transmission shaft 62. The timing belt 44 is wound around the registration small-diameter pulley 55 and the transmission shaft pulley 63. Thus, the registration roller 34 and the transmission shaft 62 rotate in the same direction.

The clutch gear 45 is disposed on the transmission shaft 62 via the electromagnetic clutch 42. When the electromagnetic clutch 42 is connected, a drive force of the drive motor 38 is transmitted to the transmission shaft 62. When the electromagnetic clutch 42 is disconnected, the switching member 40 is held at the striking position or the evacuation position owing to a rotational load from a slip rotator, to be described in detail later.

The gear 51 is engaged with the gear 67. The gear 51 is rotatably supported by a shaft 51*a* inserted into the gear 51, The shaft 51*a* is secured to the inner side plate 46*a*. The spring 66 is disposed between the inner side plate 46*a* and the disc member 91. The disc member 91 is disposed between the spring 66 and the gear 51. The gear 51 is loaded with a pressure from the spring 66. Thus, even when the electromagnetic clutch 42 is disconnected, the switching member 40 can keep its position.

The shaft 41 of the switching member 40 is supported by the inner side plate 46*a* and another inner side plate disposed on a left side in FIG. 9A so as to be rotatable within a predetermined angular range. The shaft 41 of the switching member 40 is rotatably inserted into the gear 67 that is engaged with the clutch gear 45. Thus, the gear 67 is rotatable relative to the shaft 41. The disc member 87 is disposed between the gear 67 and the inner side plate 46*a*, to generate a frictional force with the spring 60. The shaft 41 is rotatably inserted into the spring 60 and the disc member 87.

The disc member 87 has a convex engagement part that is engaged with a groove formed on the shaft 41 in a longitudinal direction. The disc member 87 is slidable in a longitudinal direction of the shaft 41 and rotatable along with rotation the shaft 41 in the same direction. This configuration makes it possible to transmit a rotational drive force and torque of the gear 67 to the shaft 41.

The gear 67, the spring 60, and the disc member 87 form a slip rotator. The slip rotator automatically blocks transmission of torque to the shaft 41 when an excessively large load is applied to the gear 67, by making the gear 67 slip relative to the shaft 41.

Referring to FIG. 9A, the clutch gear 45, the gear 51, and the gear 67 are restricted in axial movement, by mounting retaining rings on each shaft rotatably supporting each gear.

As the electromagnetic clutch 42 is connected and the registration roller 34 is rotary-driven, a drove force is transmitted through the timing belt 44, the clutch gear 45, and the gear 67 to rotate the shaft 41 and to switch the position of the switching member 40. At this time, the gear 51 is also rotated. The drive force transmitter makes the registration roller 34 and the shaft 41 rotate in the opposite directions.

Referring to FIG. 9A, the filler 64 is secured to a right end of the shaft 41 into which the gear 67 is inserted. The filler 64 is in the form of a cup having a cutout used for detecting the rotational position of each switching member 40. The position detection sensor 65 for detecting the cutout position of the filler 64 is disposed gripping the outer periphery of the filler 64. The position detection sensor 65 includes a transmissive photosensor. The position detection sensor 65 detects the rotational position (e.g., striking position, switching position, evacuation position) of the switching member 40. The position detection sensor 65 is secured to a sensor bracket 68 secured to the inner side plate 46*a*.

In the slip rotator, the gear 67 is loaded by the disc member 87 and the spring 60 relative to the filler 64. As a torque above a certain value acts on the gear 67, a slip is caused between the disc member 87 and the filler 64. Thus, the peripheral components never get broken even when the registration roller 34 is excessively rotated. Since the number of rotations of the registration roller 34 is accurately measurable by the encoder sensor 36, the rotational position (rotational angle) of the switching member 40 is controllable.

The screw pins 89 and 90, serving as second rotation regulators, are each secured to the inner side plate 46*a* with a screw so as to protrude toward the conveyer 32 side in a direction perpendicular to the inner side plate 46*a*. (The screw pin 90 is illustrated in FIGS. 9B and 9C while being omitted in FIG. 9A.)

The spring pin 88, serving as a first rotation regulator, is secured to the shaft 41 at right angle. The spring pin 88 is extended in the space between the screw pins 89 and 90. As the registration roller 34 normally rotates in a direction indicated by arrow NR (corresponding to the ejection direction Xa) in FIG. 10 and the shaft 41 rotates in a direction indicated by arrow A in FIG. 9B, the spring pin 88 is brought into contact with the screw pin 90, thereby restricting rotation of the shaft 41. At this time, the switching member 40 is held in the striking position.

On the other hand, as the registration roller 34 reversely rotates in a direction indicated by arrow RR in FIG. 10 and the shaft 41 rotates in a direction indicated by arrow B in FIG. 9C when the switching member 40 is in the striking position, the spring pin 88 is brought into contact with the screw pin 89, thereby restricting rotation of the shaft 41. At this time, the switching member 40 is held in the evacuation position.

As a drive force is transmitted to the gear 67 after the spring pin 88 has been brought into contact with the screw pins 89 or 90, an excessively large load is applied to the gear 67 and a slip is caused between the disc member 87 and the filler 64, thereby blocking transmission of torque to the shaft 41.

As described above, the rotational position (e.g., striking position, switching position, evacuation position) of the switching member 40 can be detected by the position detection sensor 65 by detecting the rotational position of the filler 64 secured to the shaft 41.

Figure 11:
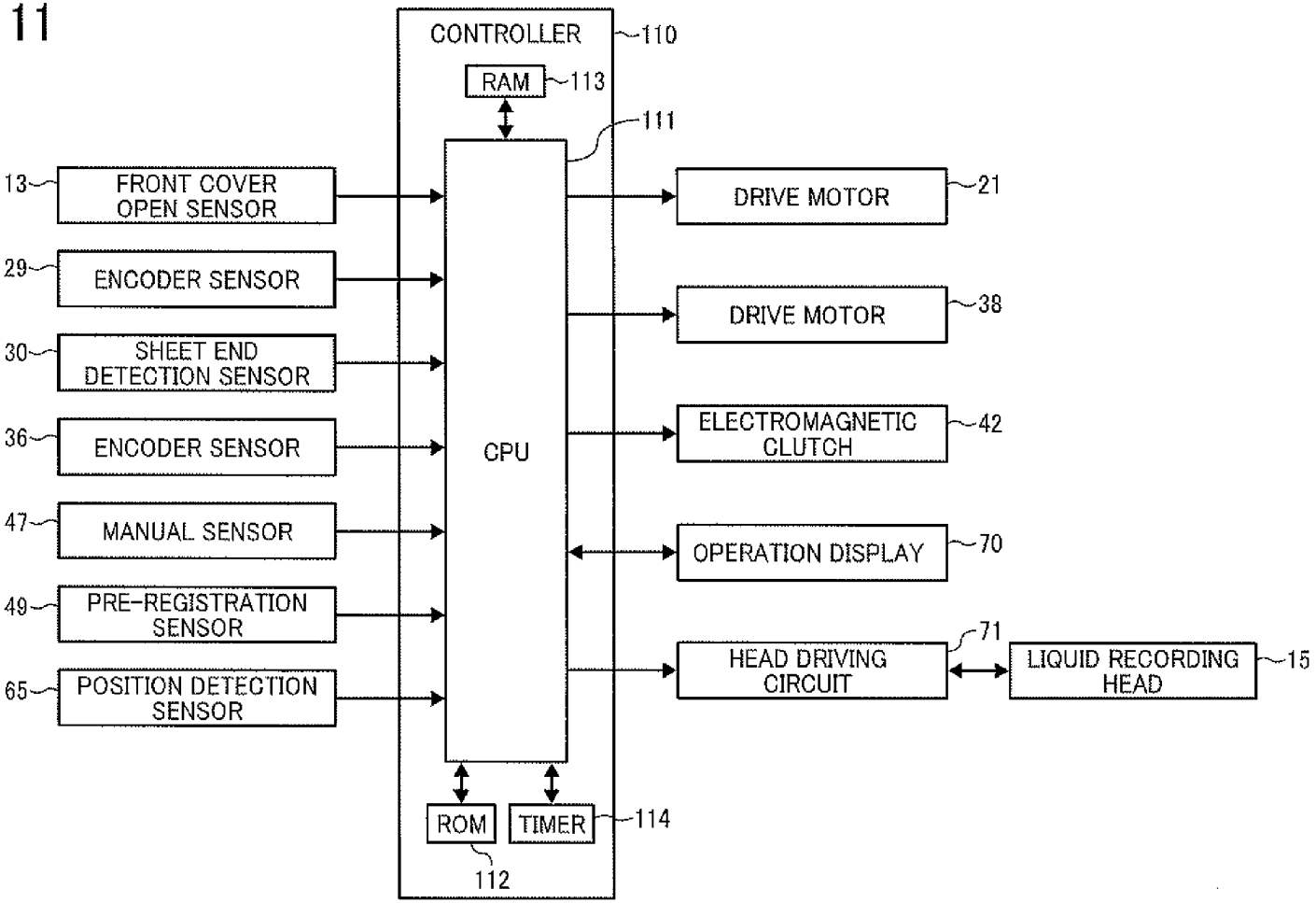
FIG. 11 is a block diagram of a controller in the image forming apparatus illustrated in FIG. 1.

A configuration of the controller 110 of the image forming apparatus 1 is described below with reference to FIG. 11. FIG. 11 is a block diagram of the configuration of the controller 110 in the image forming apparatus 1 illustrated in FIG. 1.

The controller 110 illustrated in FIG. 11 controls major parts of the image forming apparatus 1, including a part of the image former 2, the feeder 3, the ejector 4, the sheet conveying device, the conveyer 32, and the driver 33. Referring to FIG. 11, the controller 110 includes a microcomputer including a central processing unit (CPU) 111 having functions of calculation and control, a read only memory (ROM) 112, a random access memory (RAM) 113, and a timer 114.

The RAM 113 temporarily stores various data, such as calculation results of the CPU 111. The ROM 12 previously stores necessary control programs (to be described later referring to FIG. 13) and fixed data.

To the CPU 111, each of the front cover open sensor 13, the encoder sensor 29, the sheet end detection sensor 30, the encoder sensor 36, the manual sensor 47, the pre-registration sensor 49, and the position detection sensor 65 is electrically connected via an input port. In addition, to the CPU 111, a head driving circuit 71 for driving the liquid recording head 15, the drive motor 21, the drive motor 38, and the electromagnetic clutch 42 is electrically connected via an output port. Further, an operation display 70 is electrically connected to the CPU 111 via an input port and an output port.

A set position detector, for detecting whether or not a trailing edge of a manually-inserted cut sheet is set at a proper set position relative to the image former 2, is described below. The set position detector includes the sheet end detection sensor 30 as a major component and the encoder sensors 29 and 36 as sub components.

In the state illustrated in FIG. 7 or 13 (to be described later), the set position detector provides the function of detecting (1) skew, (2) the size of the cut sheet, and (3) the right end of the cut sheet. In a case in which at least one of these three items does not meet each criterion, it is determined that the set position is wrong.

(1) Detection of Skew

The sheet end detection sensor 30 mounted on the carriage 20 detects the right end of the cut sheet 50 (or the sheet 10) while the carriage 20 is scanning in the main scanning direction Y ("first detection"). After tile cut sheet 50 (or the sheet 10) is conveyed in the ejection direction Xa for a predetermined amount, the sheet end detection sensor 30 detects the right end of the cut sheet 50 (or the sheet 10) again ("second detection"). The difference in detected position between the first and second detections represents a skew. When the skew is in excess of a specified value, the set position is determined to be wrong.

(2) Detection of Size of Cut Sheet

The sheet end detection sensor 30 detects the right end of the cut sheet 50 (or the sheet 10) while the carriage 20 is scanning in the main scanning direction Y. The carriage 20 keeps on scanning to detect the left end of the cut sheet 50 (or the sheet 10). The difference in detected position between the right and left ends represents the width (size) of the sheet. When the detected size of the cut sheet 50 (or the sheet 10) is out of a specified range, the set position is determined to be wrong.

(3) Detection of Right End of Sheet

The sheet end detection sensor 30 detects the right end of the cut sheet 50 (or the sheet 10) while the carriage 20 is scanning in the main scanning direction Y. When the detected value is out of a specified range, the set position is determined to be wrong.

The operation display 70 includes: a touch panel, switches, and keys, for instructing each part of the image forming apparatus 1 to perform each operation; a liquid crystal display for visually checking the operation; and a sound generator. The liquid crystal display and the sound generator each serve as an informer. Examples of the sound generator include a voice generator and a buzzer that generates a warning sound.

In the first embodiment, the CPU 111 serves as a first controller. Specifically, the CPU 111 serving as the first controller controls the drive motor 38 and the electromagnetic clutch 42 such that the registration roller 34 normally rotates to convey the cut sheet 50 from the manual conveyance path 11 to the ejector 4 and that the switching member 40 swings from the evacuation position to the striking position, based on a signal indicating that the set potion of the cut sheet 50 is wrong, transmitted from the set position detector (including the sheet end detection sensor 30).

In addition, the CPU 111 has an interlock function that stops operations of the head driving circuit 71 of the liquid recording head 15, the drive motor 21, the drive motor 38, and the electromagnetic clutch 42, based on a signal indicating that the cover is open, transmitted from the front cover open sensor 13.

Moreover, the CPU 111 has a function that causes the liquid crystal display and the sound generator in the operation display 70 inform the user of the status of each part, such as the electromagnetic clutch 42, drive motors 21 and 38, etc., based on a signal from each sensor.

Now, a manual feeding preparation operation for a manually-inserted cut sheet (simply referred to as "sheet" in FIG. 13), performed by the image forming apparatus 1 under control of the controller 110 is described with reference to FIG. 13. For the illustrative purposes, however, user operation performed at S21 to S25 (blocks drawn by thick lines) are described, together with operation performed by the controller 110 in response to such user operation.

Figure 13:
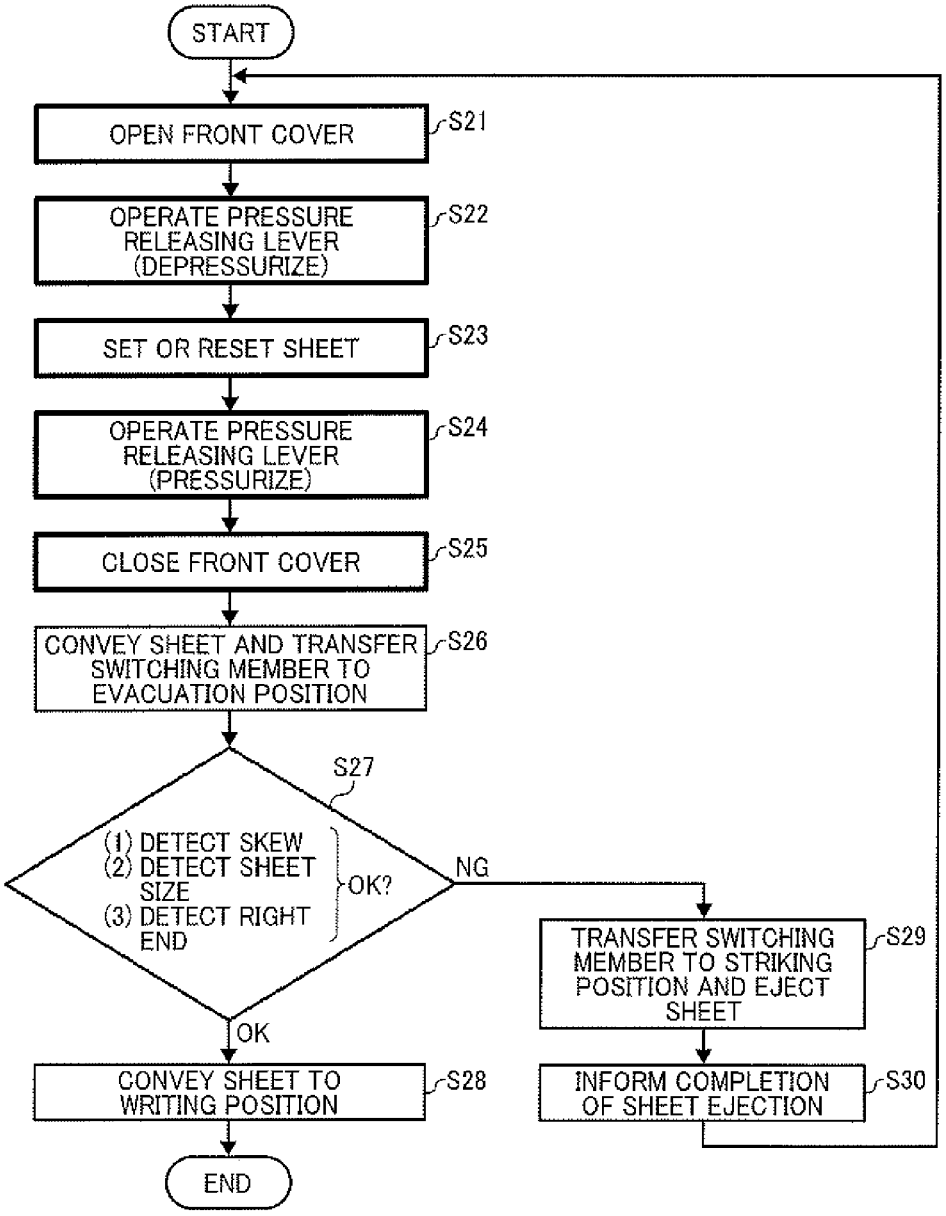
FIG. 13 is a flowchart of a manual feeding preparation operation for the image forming apparatus according to the first embodiment.

In step S21 in FIG. 13, as the user opens the front cover 12 as illustrated in FIG. 2, the controller 110 receives a detection result indicating the open state of the front cover 12 from the front cover open sensor 13. In step S22, as the user operates the pressure releasing lever 54 in the direction indicated by arrow in FIG. 2, the pressure rollers 35 are separated upward from the registration roller 34 to be held in the depressurizing position. In step S23, the user inserts the cut sheet 50 from the ejection port 4*a* (illustrated in FIG. 2) until the leading edge 50*a* of the cut sheet 50 strikes against the switching member 40 held in the striking position, as illustrated in FIG. 6.

Whether or not the leading edge 50*a* of the cut sheet 50 has struck against the switching member 40 is detected by the manual sensor 47. In step S24, the user operates the pressure releasing lever 54 in the direction indicated by arrow in FIG. 1, so that the pressure rollers 35 are pressed against the registration roller 34 to be held in the pressurizing position. In step S25, the user closes the front cover 12. The controller 110 receives a detection result indicating the close state of the front cover 12 from the front cover open sensor 13.

In step S26, the cut sheet 50 having struck against the switching member 40 is then automatically conveyed in the conveyance direction Xc, as illustrated in FIG. 7, as the electromagnetic clutch 42 (illustrated in FIG. 9A) is connected and the registration roller 34 is reversely rotated. At the same time in step S26, the switching member 40 swings to the evacuation position so as not to interrupt conveyance of the cut sheet 50.

As the trailing edge 50*b* of the cut sheet 50 reaches an immediately upstream position of the print start position in the conveyance direction Xc, the set position of the trailing edge 50*b* of the cut sheet 50 is detected by the set position detector (including the sheet end detection sensor 30) mounted on the carriage 20.

The set position detector then performs detection of (1) skew, (2) the size of the cut sheet, and (3) the right end of the cut sheet. In step S27, the CPU 111 refers to fixed data or a data table stored in the ROM 112 to determine whether the set position is good or wrong.

When the set position is determined to be good, in step S28, the trailing edge 50*b* of the cut sheet 50 is conveyed to a writing position where the liquid recording heads 15 are capable of writing an image on the cut sheet 50, by the registration roller 34 normally rotated and the pressure rollers 35, as illustrated in FIG. 8.

Figure 12:
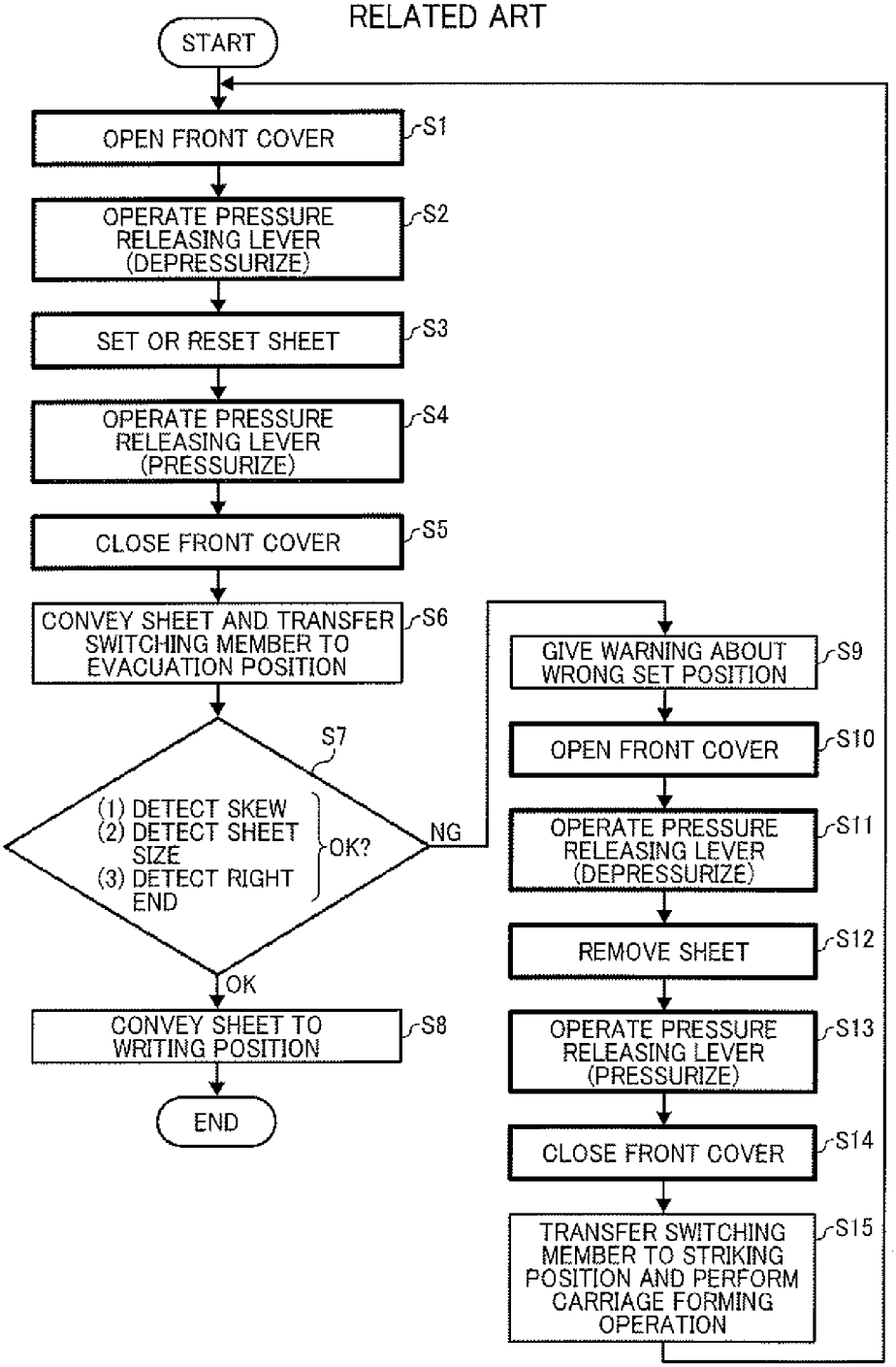
FIG. 12 RELATED ART
FIG. 12 is a flowchart of a manual feeding preparation operation for a related-art image forming apparatus.

In this operation according to the first embodiment, the above-described steps S21 to S28 are the same as steps S1 to S8, respectively, in a related-art operation illustrated in FIG. 12. When the set position is determined to be wrong in step S27, the following operation is automatically performed, which is different from the related-art operation illustrated in FIG. 12 to be described later.

In step S29, the CPU 111 serving as the first controller automatically performs an operation that causes the cut sheet to be automatically ejected and causes the switching member 40 to automatically transfer to the striking position. Specifically, the CPU 111 controls the drive motor 38 and the electromagnetic clutch 42 such that the registration roller 34 normally rotates to convey the cut sheet 50 from the manual conveyance path 11 to the ejector 4 and that the switching member 40 swings from the evacuation position to the striking position.

In step S30, information indicating completion of ejection of the cut sheet is displayed on the liquid crystal display of the operation display 70. Thus, the user recognizes that a sheet re-setting operation is needed and performs the sheet re-setting operation (i.e., step S21 and subsequent steps).

Now for the comparative purposes, the related-art manual feeding preparation operation for a manually-inserted cut sheet (simply referred to as "sheet" in FIG. 12) is described with reference to FIG. 12. In FIG. 12, blocks drawn by thick lines represent manual operations performed by a user. Further, for simplicity, it is assumed that hardware of the related-art image forming apparatus is substantially the same as that of the image forming apparatus 1, except for a controller that controls hardware of the image forming apparatus. For this reasons, the same reference numerals are used to explain the hardware component.

As described below, the image for apparatus according to the related art only controls the drive motor 38 and the electromagnetic clutch 42 such that the switching member 40 is switched from the striking position to the evacuation position when the registration roller 34 is reversely rotated and the trailing edge of the cut sheet 50 occupies the set position. In addition, the image forming apparatus according to the related art causes the liquid crystal display and the sound generator in the operation display 70 inform the user, only based on a signal indicating that the set potion of the cut sheet 50 is wrong, transmitted from the set position detector (including the sheet end detection sensor 30).

Referring back to FIG. 12, when the set position is determined to be wrong, in step S9, a CPU displays a warning about wrong set position on the liquid crystal display of the operation display 70 or generates a warning sound. Operations to be performed by the user and the operation order may be also displayed on the liquid crystal display. Thus, the user can recognize that the set position is wrong and a sheet re-setting operation is needed in step S9. The user then opens the front cover in step S10, and operates the pressure releasing lever 54 to a depressurizing state in step S11.

In step S12, the user removes the cut sheet, determined to be in a wrong set position, from the positions of the pressure rollers 35 separated from the registration roller 34. The user then operates the pressure releasing lever 54 to a pressurizing state in step S13 in the same manner as in step S4, and closes the front cover in step S14 in the same manner as in step S5.

In step S15, an initial operation; including a carriage forming operation and a switching operation for transferring the switching member 40 to the striking position, is automatically performed. Since the front cover 12 was opened in the prior step, the carriage needs to check whether or not foreign substances present on the print surface by slowly scanning the whole area in the main scanning direction. Such a scanning operation causes a waste of time. To omit the time spent for the scanning operation, the initial operation is automatically performed in step S15.

As the switching member 40 has switched to the striking position through steps S10 to S15, the cut sheet gets ready for being reset. The user then performs a series of steps S1 to S5 to reset the cut sheet.

In the related-art image forming apparatus, as described above, the switching member 40 is not in the striking position when reset of the cut sheet is required, and therefore a series of complicated operations is needed. Specifically, the series of complicated operations includes manual operations (e.g., opening the front cover, operating the pressure releasing lever to the depressurizing state, removing the cut sheet, operating the pressure releasing lever to the pressurizing state, closing the front cover) and the initial operation (e.g., the carriage forming operation and the switching operation for switching the switching member 40 to the striking position). The series of complicated operation takes a long time.

Further, when the front cover is opened, the CPU stops an operation of the drive motor 38, etc., based on a signal indicating that the cover is open, transmitted from the front cover open sensor 13. By this interlock function of the CPU, the drive motor 38 cannot be put into operation.

In contrary, according to the first embodiment of the present invention, when the set position is determined to be wrong, the cut sheet can be properly reset without complicated operation, because the cut sheet is ejected without being touched by the user and the switching member 40 is automatically transferred to the striking position at the same time.

Since no complicated operation is required, a waste of time can be minimized.

Modification 1

Figure 14A:
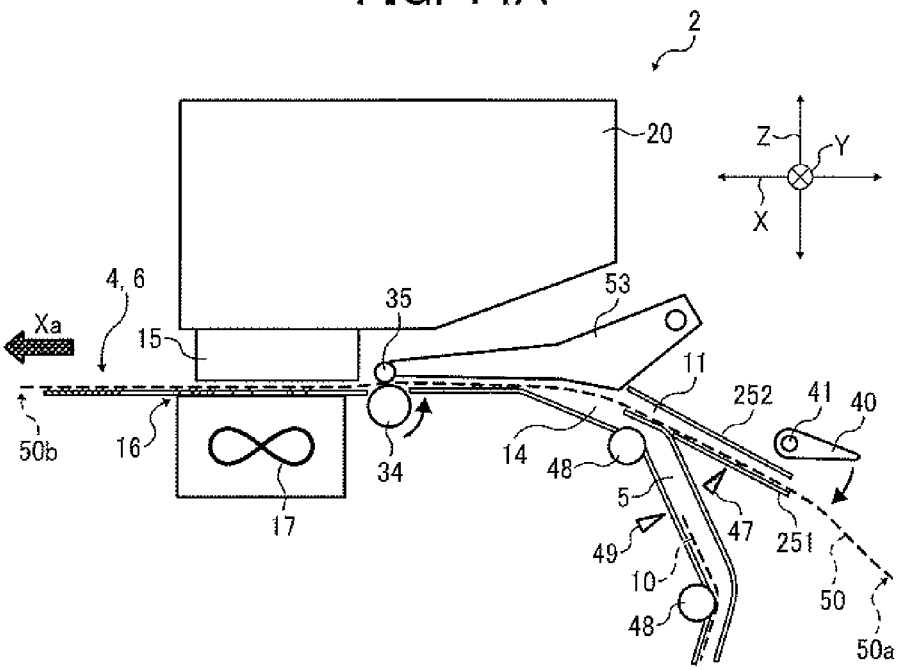
FIGS. 14A and 14B are side views of an image forming apparatus according to a first modification in a cut sheet ejection operation.
Figure 14B:
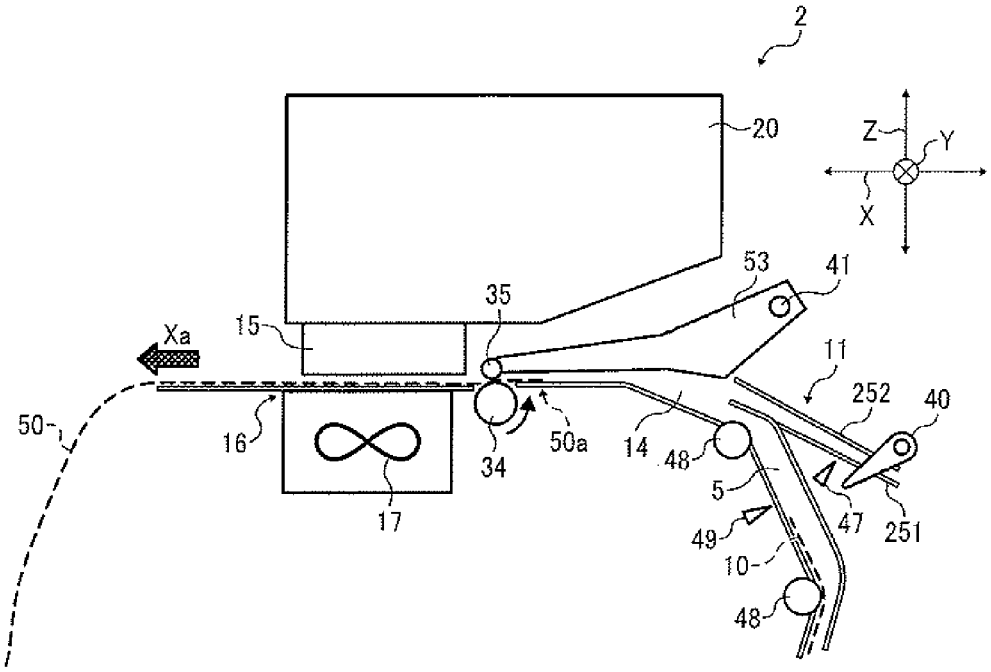

A first modification is described below with reference to FIGS. 14A and 14B. FIGS. 14A and 14B are side views of an image forming apparatus according to the first modification, in a cut sheet ejection operation.

The first modification is different from the first embodiment in the following two aspects. With respect to the first aspect, step S29 in the first embodiment is modified such that conveyance of the manually-inserted cut sheet 50 to the ejector 4 is completed while the cut sheet 50 is being sandwiched by the registration roller 34 and the pressure rollers 35, as illustrated in FIG. 14B.

With respect to the second aspect, the CPU 111 serves as a second controller in addition to serving as the first controller. The CPU 111 serving as the second controller controls the electromagnetic clutch 42 and the drive motor 38 such that the electromagnetic clutch 42 gets connected and the switching member 40 swings to the striking position at the time when the manual sensor 47 detects absence of the manually-inserted cut sheet 50, to transfer the switching member 40 to the striking position while the manually-inserted cut sheet 50 is being ejected.

According to the first aspect, when the set position is determined to be wrong, the cut sheet 50 is conveyed toward the ejector 4 (while the switching member 40 is in the striking position), and the conveyance is stopped while the cut sheet 50 is being sandwiched by the registration roller 34 and the pressure rollers 35, as illustrated in FIG. 14B.

A stop position of the trailing edge of the cut sheet 50 (corresponding to the leading edge 50*a* of the manually-inserted cut sheet 50) is between a position within the manual conveyance path 11 (formed of the manual sheet conveyance guide plates 251 and 252) and the nip position of the registration roller 34.

The amount of conveyance of the cut sheet 50 is controllable by the accumulated normal/reverse rotation pulse number of the registration roller 34, detected by the encoder sensor 36, which may be a constant value regardless of the length of the cut sheet 50.

Thus, the cut sheet 50 is prevented from falling and being soiled or bent.

According to the second aspect, when the set position is determined to be wrong, the cut sheet 50 is conveyed toward the ejector 4 in the ejection direction Xa, as illustrated in FIG. 14A. To transfer the switching member 40 to the striking position while the manually-inserted cut sheet 50 is being ejected, the electromagnetic clutch 42 gets connected and the switching member 40 swings to the striking position at the time when the manual sensor 47 detects absence of the manually-inserted cut sheet 50. Thus, the cut sheet 50 and the switching member 40 are controllable without being touched by the user.

Modification 2

Figure 15:
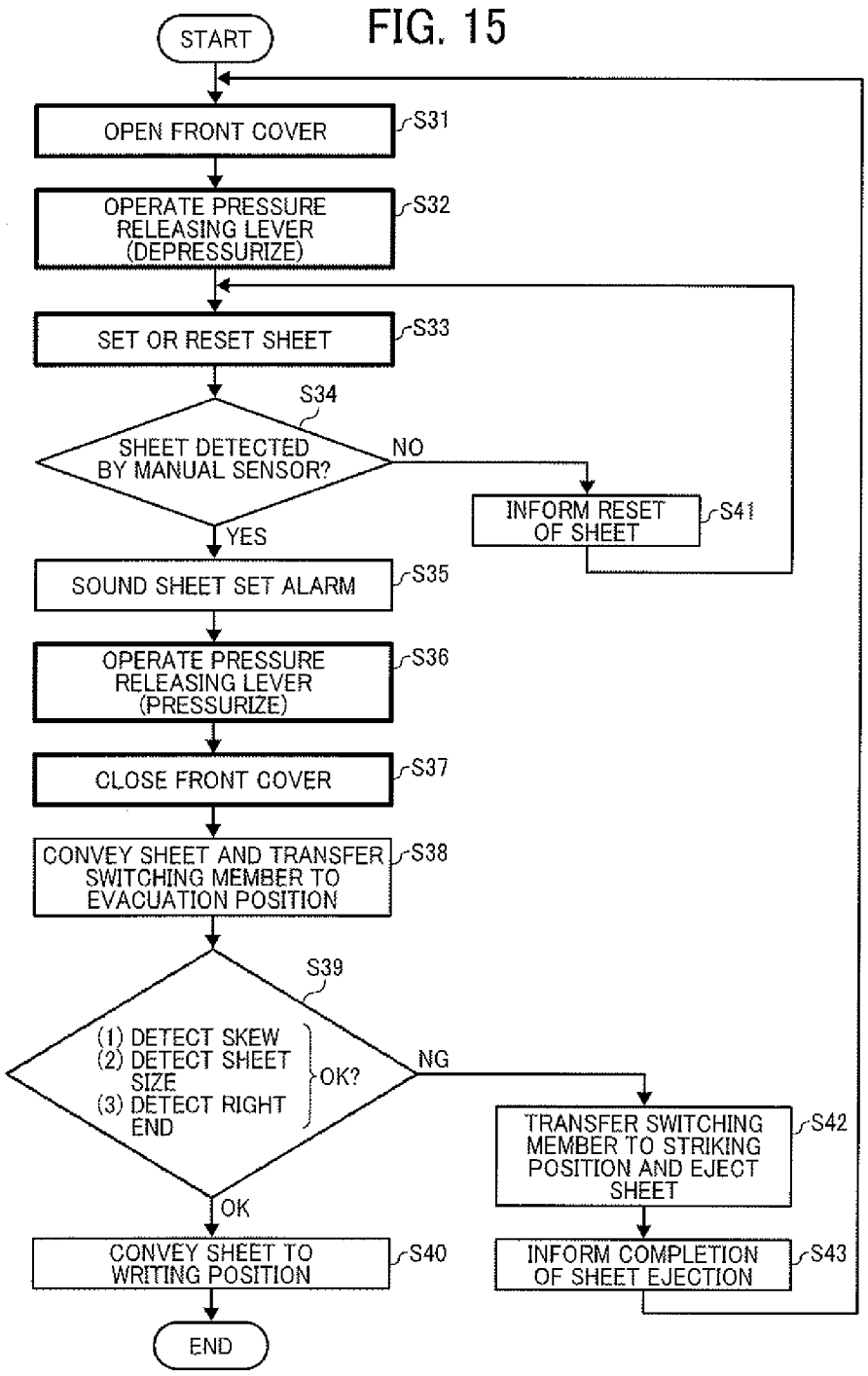
FIG. 15 is a flowchart of a manual feeding preparation operation for an image forming apparatus according to a second modification.

A second modification is described below with reference to FIG. 15. FIG. 15 is a flowchart of a manual feeding preparation operation for an image forming apparatus according to the second modification.

The second modification is different from the first modification in that the CPU 111 serves as a third controller in addition to serving as the second controller. The CPU 111 serving as the third controller controls the sound generator in the operation display 70 to inform that the manually-inserted cut sheet 50 is set at the set position based on a signal indicating that the manually-inserted cut sheet 50 has struck against the switching member 40 in the striking position, transmitted from the manual sensor 47.

The operation according to the second modification illustrated in FIG. 15 is different from that according to the first embodiment and the first modification illustrated in FIG. 13 in that a sheet set alarm is sounded in step S35 when the manual sensor 47 detects presence of the cut sheet in step S34 and that reset of the cut sheet is informed in step S41.

In other words, when the leading edge 50*a* of the cut sheet 50 is properly set within the manual conveyance path 11 by striking against the switching member 40 in the striking position, a sheet set alarm is sounded as the manual sensor 47 detects presence of the cut sheet.

In a case in which the cut sheet 50 is manually inserted as illustrated in FIG. 6, the cut sheet 50 may enter into the conveyance path 5 exclusively used for the rolled sheet, without entering into the manual conveyance path 11, depending on the degree of curl of the leading edge 50*a* of the cut sheet 50.

To avoid such a phenomenon, the image forming apparatus according to the second modification can inform the user of proper set of the cut sheet by means of a sheet set alarm, etc., optionally together with a display. When the cut sheet has not properly set, the image forming apparatus informs the user of wrong set of the cut sheet to prompt the user to reset the cut sheet. Wrong set of the cut sheet may be displayed on the liquid crystal display of the operation display 70 and/or alarmed by a buzzer sound, to reliably prompt the user to reset the cut sheet.

Modification 3

Figure 16A:
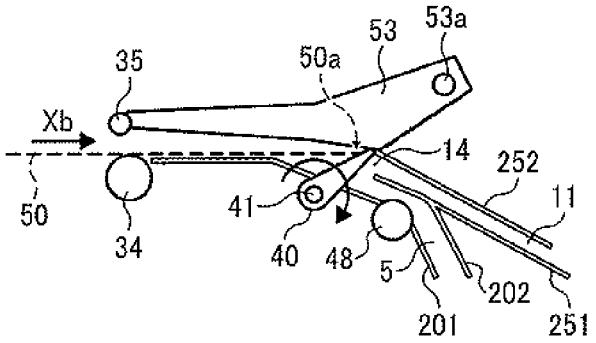
FIGS. 16A to 16C are side views of an image forming apparatus according to a third modification.
Figure 16B:
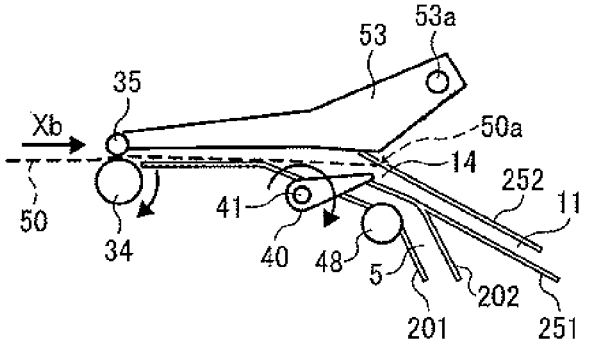
Figure 16C:
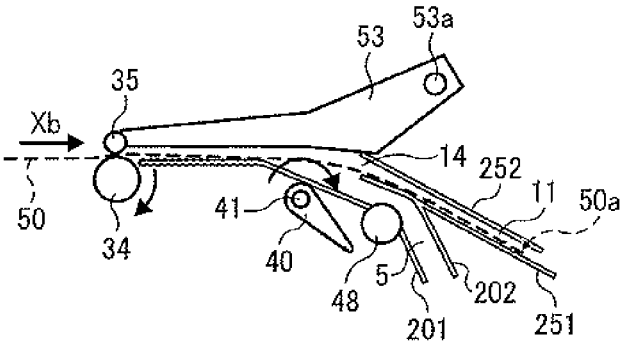

A third modification is described below with reference to FIGS. 16A to 16C. FIGS. 16A to 16C are side views of an image forming apparatus according to the third modification.

The third modification is different from the first embodiment in the following two aspects. Firstly, the installation position of the switching member 40 is changed to an upstream side of the joined conveyance path 14 relative to the insertion direction Xb. Secondly, the switching member 40 is made switchable among the striking position illustrated in FIG. 16A, the evacuation position illustrated in FIG. 16C, and a separation position illustrated in FIG. 16B. The switching member 40 in the separation position allows the cut sheet 50 only to enter into the manual conveyance path 11.

The third modification may be applied to the second modification. In the third modification, to make the switching member 40 swingable among the striking position, evacuation position, and separation position, the driver 33 (illustrated in FIGS. 9A) may be modified or the drive motor 38 is replaced with another drive motor.

In the first embodiment, when the cut sheet 50 is manually inserted and set, the cut sheet 50 may enter into or strike against the conveyance path 5, exclusively used for the rolled sheet without entering into the manual conveyance path 11, depending on the degree of curl of the leading edge 50*a* of the cut sheet 50. The third modification has solved such a problem.

The image forming apparatus according to some embodiments of the present inventions is not limited to an inkjet recording apparatus. The image forming apparatus according to some embodiments of the present invention may be an electrophotographic copier or printer which forms images on either a long sheet drawn from a sheet roll or a cut sheet manually inserted. Specific examples of the long sheet include, but are not limited to, various recording media such as normal sheet, recording sheet, gloss sheet, and coated sheet. Specific examples of the cut sheet used for manual insertion include, but are not limited to, various recording media such as normal sheet, recording sheet, gloss sheet, coated sheet, thick sheet, envelope, thin sheet, and film (e.g., OHP sheet), and a cut piece of the long sheet. The long sheet and the cut sheet may be made of paper, fiber, or plastic.

The liquid discharge head of the inkjet recording apparatus includes an energy generation source. Specific examples of the energy generation source include, but are not limited to, a piezoelectric actuator (e.g., a laminated piezoelectric element, a thin-film piezoelectric element), a thermal actuator using a thermoelectric conversion element such as a heat element, and an electrostatic actuator including a vibration plate and a counter electrode.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a feeder to feed a recording medium;

an image former to form an image on the recording medium;

an ejector to eject the recording medium having the image thereon;

a conveyance path to guide the recording medium fed from the feeder to the image former;

a manual feeder to feed a manually-inserted recording medium from the ejector to a manual conveyance path;

the manual conveyance path to guide the manually-inserted recording medium fed from the manual feeder, to the image former via a downstream side of the conveyance path in an ejection direction;

a conveyer to convey the recording medium fed from the feeder to the image former via the conveyance path and to convey the manually-inserted recording medium fed from the manual feeder to the image former via the manual conveyance path, the conveyer being rotatable either normally or reversely;

a drive source to drive the conveyer to rotate either normally or reversely;

a switching member being a claw-like member disposed on a shaft, the switching member swingable between an evacuation position and a striking position as the shaft rotates, the switching member in the evacuation position evacuated from the manual conveyance path to allow the manually-inserted recording medium to advance, the switching member in the striking position entered into the manual conveyance path to allow a leading edge of the manually-inserted recording medium to strike against the switching member, the switching member configured to switch from the striking position to the evacuation position as the conveyer reversely rotates;

a drive force transmitter to transmit a drive force from the drive source to both the conveyer and the shaft;

a slip rotator to give a rotational load to the shaft;

a clutch coupled to the chive force transmitter, configured to transmit the drive force to the shaft when being connected, and to hold the switching member at the striking position or the evacuation position when being disconnected owing to the rotational load from the slip rotator;

a set position detector to detect whether a trailing edge of the manually-inserted recording medium is positioned at a set position or not relative to the image former; and a first controller to control the drive source and the clutch such that the conveyer normally rotates to convey the manually-inserted recording medium from the manual conveyance path to the ejector and that the switching member swings from the evacuation position to the striking position, based on a signal indicating that the set position is wrong, transmitted from the set position detector.

2. The image forming apparatus of claim 1, wherein conveyance of the manually-inserted recording medium to the ejector is completed while the manually-inserted recording medium is being held by the conveyer.

3. The image forming apparatus of claim 1, further comprising:

a recording medium detector disposed downstream from the striking position in the manual conveyance path in the ejection direction, to detect presence or absence of the manually-inserted recording medium; and a second controller to control the clutch and the drive source such that the clutch gets connected and the switching member swings to the striking position at the time when the recording medium detector detects absence of the manually-inserted recording medium, to transfer the switching member to the striking position while the manually-inserted recording medium is being ejected.

4. The image forming apparatus of claim 3, further comprising:

an informer; and a third controller to control the informer to inform that the manually-inserted recording medium is set at the set position, based on a signal indicating that the manually-inserted recording medium has struck against the switching member, transmitted from the recording medium detector.

5. The image forming apparatus of claim 1, wherein the switching member is disposed on an upstream side of a joined conveyance path in the ejection direction, the joined conveyance path disposed on a downstream side of the conveyance path and the manual conveyance path in the ejection direction, and wherein the switching member is switchable among the striking position, the evacuation position, and a separation position, the separation position being a position at which the switching member allows the manually-inserted recording medium to only enter into the manual conveyance path.

* * * * *